US007510089B2

(12) United States Patent
Killinger et al.

(10) Patent No.: US 7,510,089 B2
(45) **Date of Patent: *Mar. 31, 2009**

(54) STACKABLE AND NESTABLE ARTICLE HOLDER

(75) Inventors: Timothy D. Killinger, Plainfield, IL (US); Matthew G. Lerch, Chicago, IL (US); Aaron W. Smith, Plainfield, IL (US); Gilberto Cavada, Jr., Melrose Park, IL (US); Melanie L. Conklin, Chicago, IL (US)

(73) Assignee: Rubbermaid Incorporated, Fairlawn, OH (US)

( * ) Notice: Subject to any disclaimer, the term of this patent is extended or adjusted under 35 U.S.C. 154(b) by 558 days.

This patent is subject to a terminal disclaimer.

(21) Appl. No.: 11/097,470

(22) Filed: Apr. 1, 2005

(65) Prior Publication Data

US 2005/0258063 A1 Nov. 24, 2005

Related U.S. Application Data

(60) Provisional application No. 60/558,701, filed on Apr. 1, 2004, provisional application No. 60/592,266, filed on Jul. 29, 2004.

(51) Int. Cl.
*B42F 17/00* (2006.01)

(52) U.S. Cl. ..... 211/11

(58) Field of Classification Search ..... 211/10, 211/11, 126.1, 49.1, 126.2, 126.7, 126.13, 211/42; D19/90, 86, 91, 95, 99, 100, 65, D19/75, 78; D6/475, 407, 449, 466, 469
See application file for complete search history.

(56) References Cited

U.S. PATENT DOCUMENTS 428,517 A 5/1890 Pauly, Jr.

(Continued)

FOREIGN PATENT DOCUMENTS

WO WO 8900954 9/1989
WO WO 9118748 12/1991

OTHER PUBLICATIONS

International Preliminary Report on Patentability issued in PCT/US2005/011352.

(Continued)

*Primary Examiner*—Jennifer E. Novosad
(74) *Attorney, Agent, or Firm*—Marshall, Gerstein & Borun LLP

(57) ABSTRACT

An article holder has a bottom panel having a rear edge, a forward edge, and a pair of opposed side edges. The holder has a back wall that extends upward near the back edge of the bottom panel and has a lower edge, an upper edge, and a pair of opposed side edges. The back wall diverges from a plane that is substantially perpendicular to the bottom panel moving up and away from the bottom panel. A pair of side walls are spaced apart and opposed relative to one another, with one extending forward from a respective one of the side edges of the back wall and generally upward relative to a respective one of the side edges of the bottom panel. The pair of side walls diverge at least slightly away from one another both moving up away from the bottom panel and moving forward from the back wall. A storage receptacle is defined above the bottom panel, forward of the back wall and between the side walls. The storage receptacle has a width that is greater near the top edges of the side walls than near the bottom panel.

15 Claims, 12 Drawing Sheets

U.S. PATENT DOCUMENTS

| | | | | | |
|---|---|---|---|---|---|
| 660,541 | A | * | 10/1900 | Field | 211/11 |
| 2,790,542 | A | | 4/1957 | Hillman | |
| 3,393,827 | A | * | 7/1968 | Asenbauer | 206/504 |
| 3,592,344 | A | * | 7/1971 | Schade | 211/42 |
| D228,108 | S | | 8/1973 | Kerman | |
| 3,759,416 | A | | 9/1973 | Constantine | |
| 3,874,501 | A | * | 4/1975 | Cronheim | 206/425 |
| D259,456 | S | * | 6/1981 | Zeischegg et al. | D6/475 |
| D266,129 | S | | 9/1982 | Lidstrom | |
| D292,957 | S | | 12/1987 | Brussing | |
| 4,714,165 | A | | 12/1987 | Solomon | |
| 4,756,420 | A | | 7/1988 | Deaton | |
| D299,389 | S | | 1/1989 | Klodt | |
| D305,486 | S | | 1/1990 | Rabig | |
| 4,901,883 | A | * | 2/1990 | Hoffman | 220/830 |
| D309,066 | S | | 7/1990 | Foran et al. | |
| D314,215 | S | | 1/1991 | Hawes, Jr. et al. | |
| D324,239 | S | | 2/1992 | Halm | |
| 5,088,801 | A | * | 2/1992 | Rorke et al. | 312/184 |
| D334,675 | S | | 4/1993 | Evenson | |
| D335,996 | S | * | 6/1993 | Evenson | D6/553 |
| 5,325,978 | A | | 7/1994 | Rabig | |
| 5,351,826 | A | | 10/1994 | Chen | |
| 5,372,256 | A | * | 12/1994 | Chen | 206/425 |
| 5,598,932 | A | | 2/1997 | Weidert | |
| D381,691 | S | | 7/1997 | Miyake | |
| D385,921 | S | | 11/1997 | Tisbo | |
| D390,270 | S | * | 2/1998 | Cheris et al. | D19/90 |
| D390,606 | S | | 2/1998 | Cheris et al. | |
| D400,926 | S | | 11/1998 | Stravitz | |
| D420,051 | S | | 2/2000 | Conley et al. | |
| D455,459 | S | | 4/2002 | Cheris et al. | |
| 6,484,894 | B2 | | 11/2002 | Kiffmeyer | |
| D479,281 | S | * | 9/2003 | Hardwicke et al. | D21/367 |
| D480,426 | S | * | 10/2003 | Kortleven | D19/75 |
| 6,698,599 | B1 | | 3/2004 | Hannecke | |
| D498,263 | S | | 11/2004 | Goodman et al. | |
| D504,467 | S | * | 4/2005 | Killinger et al. | D19/90 |
| D512,743 | S | * | 12/2005 | Killinger et al. | D19/90 |
| D535,496 | S | * | 1/2007 | Killinger et al. | D6/475 |

OTHER PUBLICATIONS

International Search Report issued in PCT/US2005/011352.
Written Opinion of the International Searching Authority issued in PCT/US2005/011352.

* cited by examiner

STACKABLE AND NESTABLE ARTICLE HOLDER

This patent is related to and claims priority benefit of provisional application Ser. No. 60/558,701, filed on Apr. 1, 2004 and provisional application Ser. No. 60/592,266 filed on Jul. 29, 2004. This patent incorporates by reference all of the subject matter disclosed in said prior provisional applications.

BACKGROUND OF THE INVENTION

1. Field of the Disclosure

The present disclosure is generally directed to magazine, file, and document organizer and storage products, and more particularly to a stackable and nestable holder for organizing and storing such articles in a vertical orientation.

2. Description of Related Art

File folder racks and magazine holders are known in the art. These articles are typically configured to support a plurality of magazines, folders, documents, or the like adjacent one another and in a generally vertical or standing orientation. These types of storage products are, as a result, relatively tall in nature and relatively wide or deep in order to accommodate a desired width or length of magazine, file folder, or the like. Thus, such products take up a substantial amount of shelf space when shipped, stocked and/or displayed for sale.

The consumption of relatively large amounts of retail shelf space by such products is problematic, as retail shelf space is extremely valuable and manufacturers compete vigorously for adequate shelf space to display their products. Any inefficient use of retail shelf space can lead to a manufacturer's products not being adequately displayed, as well as a reduction in the number of different products a manufacturer may be allowed to display in a given retail store.

Because the profit margin for these items can be relatively small, a means for packaging these items in a compact manner is important for reducing shipment and handling costs of such low margin products.

Typical magazine holders can only be stacked with one other identical holder by inverting one of the holders, rotating it 180 degrees, and placing it on top of and nesting it with the other of the holders. Holders stacked and nested in this manner are susceptible to movement relative to one another, and can be damaged. Thus, additional packaging materials, such as cardboard, Styrofoam, plastic film and the like must be utilized to prevent product damage form relative movement between such holders from scuffing or scratching during shipment and handling.

These types of holders are typically individually packaged or packaged in pairs for shipping. Upon being prepared to be displayed for sale, the products are then unpackaged by the retailer if packaged in pairs.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present invention is generally directed to an organizer or storage device, hereinafter described as a holder, for storing and/or organizing articles such as magazines, file folders, documents, and the like in a generally vertical orientation. The disclosed holders are both stackable and nestable with like holders. When on display for sale to consumers, a plurality of the stacked and nested holders take up relatively little shelf space and take up much less shelf space than traditional holders of this type. The stacked and nested holders disclosed herein take up less space and result in more efficient packaging for shipping and stocking, and during display for sale.

Figure 1:
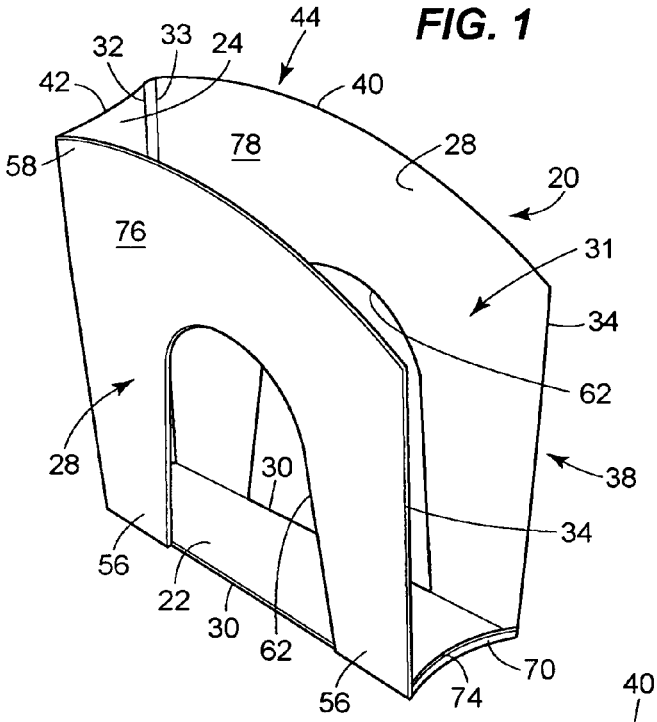
FIG. 1 shows perspective view of one example of an article holder constructed in accordance with the teachings of the present invention.

Referring now to the drawings, FIG. 1 illustrates a perspective view of one example of a holder 20 constructed in accordance with the teachings of the present invention. The holder 20 is configured for storing and/or organizing articles such as magazines, documents, file folders, or the like in a generally vertical orientation.

The disclosed holder 20 in this example has a generally horizontally oriented bottom panel 22 and a rear panel or back wall 24. The back wall 24 in this example is coupled to and extends in a generally upward direction from a rear edge 26 of the bottom panel 22. The holder 20 also has a pair of spaced apart and opposed side walls or panels 28. Bottom edges of the side walls 28 in this example are coupled to respective side edges 30 of the bottom panel 22. The side walls 28 extend in a generally upward direction from the opposed side edges 30 of the bottom panel. The side walls 28 also have rear edges 33 coupled to respective side edges 32 of the back wall 24. The side walls 28 extend in a forward direction from the side edges 32 of the back wall.

In this example, a storage receptacle 31 is formed in the space above the bottom panel 22, forward of the back wall 24, and between the side walls 28. The gap between opposed front edges 34 of the side walls 28 above a forward edge 36 of the bottom panel 22 forms a front opening 38 for forward insertion and removal of articles in the storage receptacle 31. The gap between opposed top edges 40 of the side walls 28 forward of an upper edge 42 of the back wall 24 forms a top opening 44, also for insertion and removal of articles in the storage space 31. In this example, the entire top opening 44 and a substantial majority of the front opening 38 are clear and unencumbered. This may not be the case in other optional examples. It is possible to include a top cover section (not shown) near the back wall 24 and spanning between the side walls 28. As shown and described herein, a front wall can also be included, if desired.

Figure 2:
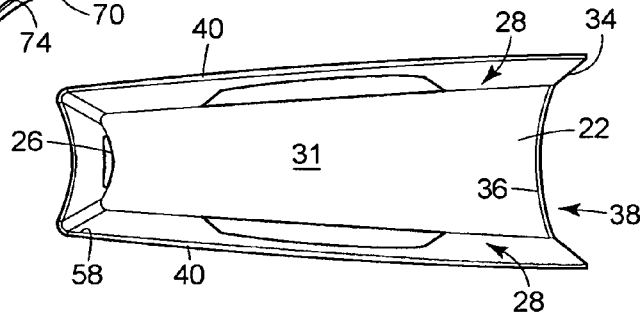
FIG. 2 shows a top view of the article holder shown in FIG. 1.

FIG. 2 illustrates a top view of the holder 20 shown in FIG. 1. In this example, the back wall 24 is concave relative to an exterior of the holder and, thus, is curved slightly inward into the storage space 31. This optional inward curvature can be included in order to add strength and structural rigidity to the overall holder 20. The inward curvature of the back wall 24 can also be added to offset or forwardly bias a plurality of magazines, file folders, or documents stored within the receptacle 31 to different degrees based on their lateral position relative to a width of the back wall 24. Thus, the back wall 24 can also be curved to provide a slight forward offset for the various articles stored in the storage receptacle 31, especially if the articles are of the same size, making them easier to grasp individually.

Figure 3:
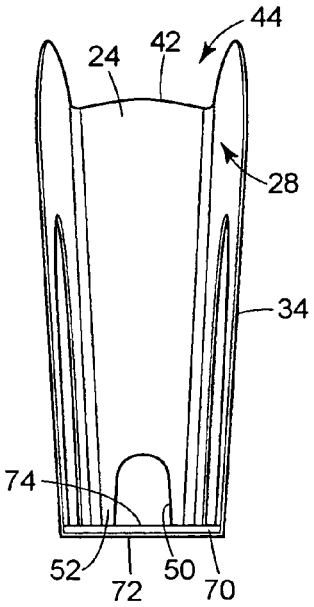
FIG. 3 shows a front view of the article holder shown in FIG. 1.

As shown in this example, as seen in FIG. 3 the upper edge 42 of the back wall 24 is optionally curved upward. The upper edge 42 can, however, be a straight linear edge and either horizontally oriented or angled to achieve a desired aesthetic appearance. The upper edge 42 can also be segmented into two or more separate sections arranged at different angles, or can be curved or shaped for achieving a desired appearance. In yet another example, the upper edge 42 of the back wall 24 can be downwardly curved as well.

As a further alternative, the back wall 24 can include one or more optional openings or windows, such as the bottom window 50. In this example, the window 50 extends a short distance upward from the rear edge 26 of the bottom panel 22. The window 50 can extend partly into the rear edge 26 of the bottom panel 22, if desired. The one or more openings, such as the window 50, can be provided to create a desired aesthetic appearance. However, the openings can also be incorporated to reduce weight of the holder 20, to provide a view to the rear edge of the contents stored within the receptacle 31, and/or to reduce cost per unit based on material reduction.

In this example, the forward edge 36 of the bottom panel 22 is also curved inwardly or concavely in a direction toward the back wall 24. Again, this forward edge 36 can vary in configuration, contour, or the like as desired to achieve a particular appearance. The curvature or shape can match that of the back wall 24 or can be different.

The bottom panel 22 in this example is a generally planar panel defining a flat upper storage surface. As with the back panel 24, the bottom panel 22 can be curved slightly concavely upward into the receptacle 31 or convexly downward from the receptacle 31 to provide additional rigidity and structure to the holder 20, and/or to provide a particular vertical offset in the height of like sized articles stored in the receptacle 31. Structural features such as ribs, ridges, grids, beam, or the like can be added to strengthen the bottom panel 22, if desired.

Figure 4:
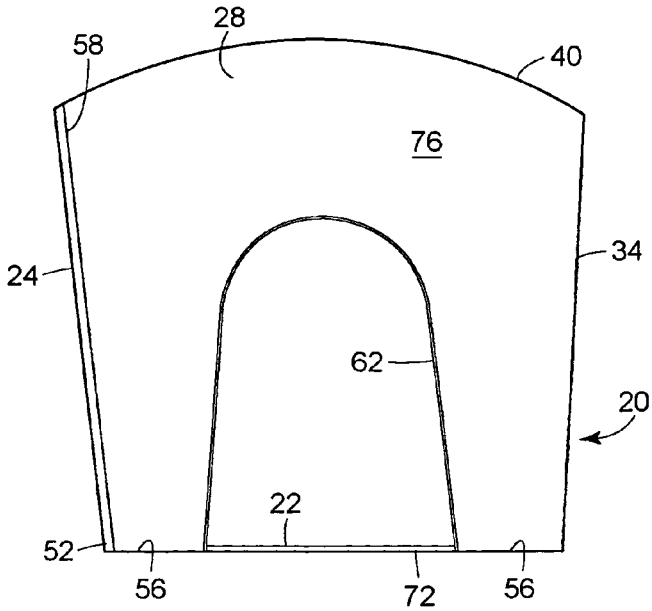
FIG. 4 shows a side view of the article holder shown in FIG. 1.

As shown in FIG. 4 in side view, the side walls 28 each include the top edge 40, a bottom edge 56 which is coupled to the bottom panel side edges 30 in this example, and rear ends 58 which are coupled to the side edges 32 of the back panel 24. In this example, the top edges 40 are arched or upwardly curved so that the side walls 28 are taller at the mid-portion than at either of the front ends 34 or the rear ends 58. The arched top edges 40 permit a user of the holder 20 to view and to grasp an article such as a file folder or magazine that is stored in the receptacle 31 by either the top front or top rear corner of the article.

As will be evident to those having ordinary skill in the art, the contour of the top edge 40 can, however, vary from that disclosed in this example and need not provide such access to the articles unless desired. Also as can be seen in FIG. 4; the side walls 28 have a tapered width or depth. The side walls 28 are narrower toward the bottom panel 22 than at the top near the top edge 40. Thus, the lower front corner of a stored article may also be exposed forward of the side walls 28 permitting a user to grasp the lower front corner of the article as well. As a result, a user can easily insert or remove articles such as magazines, file folders, or the like.

As shown in FIG. 4, the side walls 28 can also include one or more windows or openings 62 provided therein. In the disclosed example, each side wall includes one window 62 that extends a substantial distance upward into the side wall surface from the respective side edge 30 of the bottom panel 22. As with the widow 50 in the back wall 24, the windows 62 can also extend at least slightly into the edge of bottom panel 22. As will be evident to those having ordinary skill in the art, the windows 50 and 62 can vary in configuration, contour, positioning, number, and the like, depending upon the aesthetic appearance desired and/or other desired characteristics such as weight reduction, material cost savings, view of contents within the receptacle 31, or the like.

Figure 5:
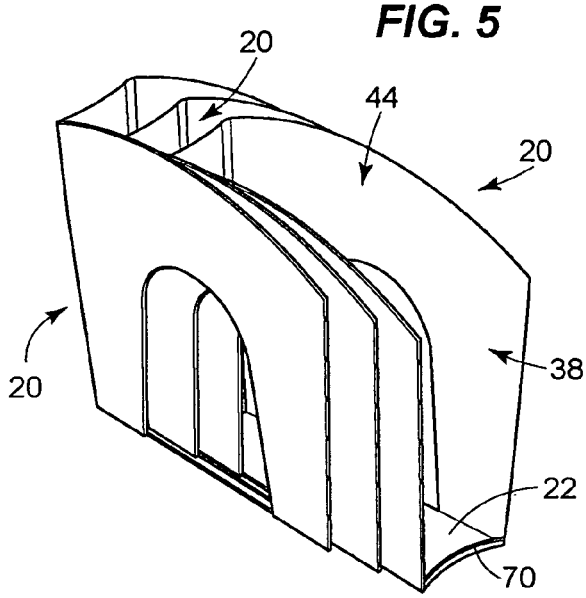
FIG. 5 shows a perspective view of three identical article holders as shown in FIG. 1 and in a stacked and nested configuration.
Figure 6:
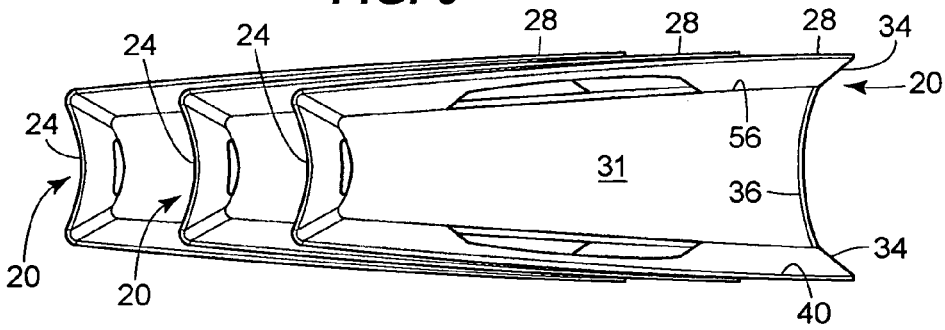
FIG. 6 shows a top view of the article holder stack of FIG. 5.
Figure 7:
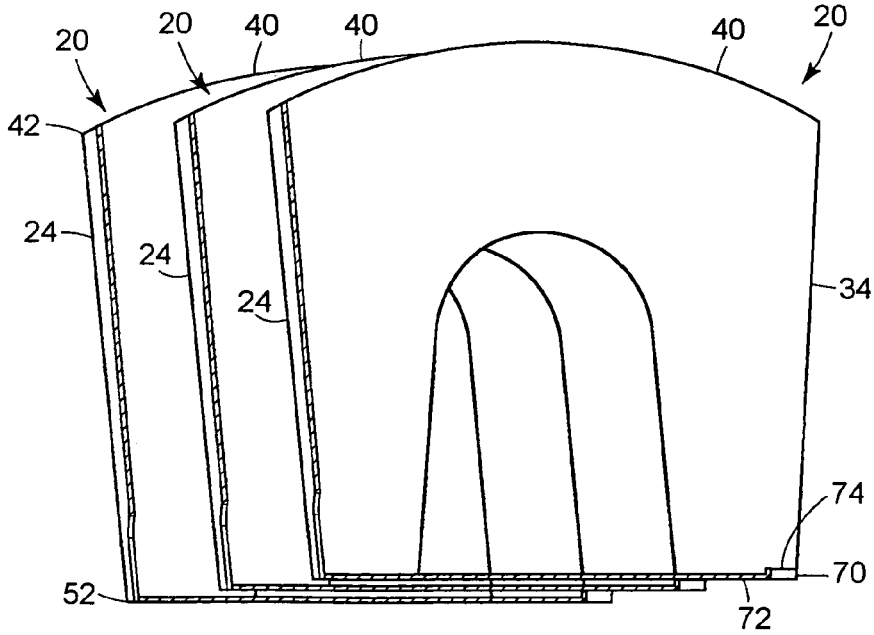
FIG. 7 shows a cross section of the article holder stack taken along line VII-VII of FIG. 6.

As shown in FIGS. 5-7, the holder 20 in this example can be stacked and nested with other like holders 20. The side walls 28 diverge slightly away from one another in two dimensions. The side walls 28 diverge from one another both moving forward from the back wall 24 toward the front ends 34 and moving upward from the bottom ends 56 toward the top edges 40. Thus, the storage receptacle 31 becomes wider toward both the top opening 44 and the front opening 38 in this example. The angle of divergence relative to a front to rear axis of the holder 20 can vary. However, a minimum angle can be included to create a sufficient draft angle for part formation and for nesting, as well as to accommodate the material wall thickness of the walls. For example, the angles can vary up to about 5°-7° from about 1° or less.

The back wall 24 in this example diverges from a plane that is substantially perpendicular to the bottom panel moving upward from its lower edge 52 toward its upper edge 42. The lean of the back wall 24 and the divergence of the side walls 28 creates a draft angle in the side walls and the back wall. This draft angle is suitable for at least two purposes. First, the part can be formed in a two piece mold as discussed below. Second, a plurality of like holders 20 can be stacked and nested relative to one another, as shown in FIGS. 5-7.

Three of the holders 20 are shown in FIGS. 5 and 6 in a horizontally forwardly stacked and nested configuration. The back wall 24 of one holder 20 is narrower than the front opening 38 of another identical holder 20. Thus, one holder can be pushed rearward into the storage receptacle 31 of another identical holder. Another holder 20 can then be nested within the one holder 20 in a similar manner. Any number of like holders 20 of this construction can be horizontally nested within one another as needed, creating a horizontal stack of the holders.

FIG. 7 illustrates a side view in cross section of the stacked holders 20 depicted in FIGS. 5 and 6. As can be seen in this view, a short front wall 70 can be provided extending upward from the forward edge 36 of the bottom panel 22. In this example, the front wall 70 is only about one-quarter inch high and acts as a vertical nesting stop or nesting limiter. As shown in FIG. 7, the bottom surface 72 of the one bottom panel 22 bears against the top surface 74 of the front wall 70 of another holder. This prevents a tight vertical nesting interference between nested holders 20.

Figure 7A:
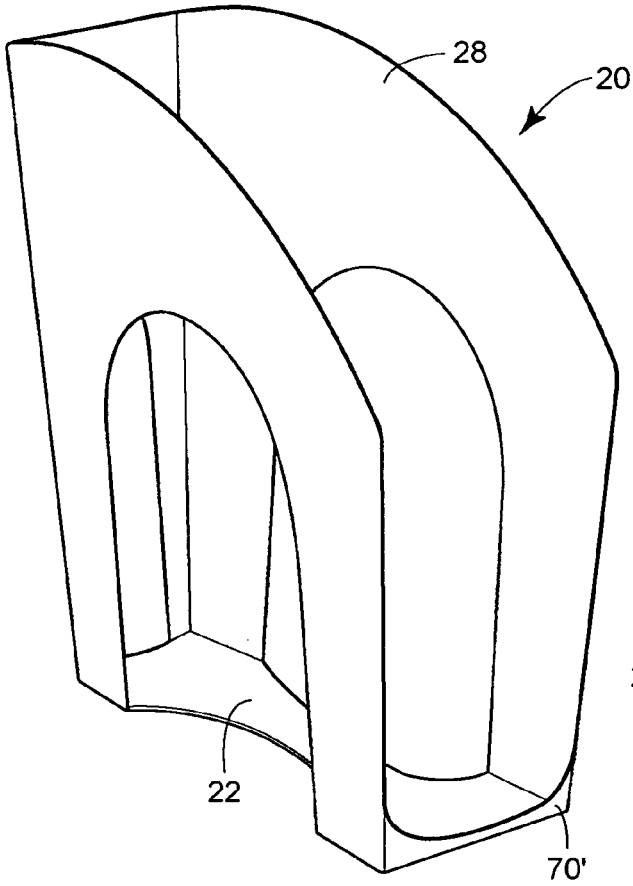
FIG. 7A shows a perspective view of the article holder of FIG. 5 including an alternate front wall.
Figure 7B:
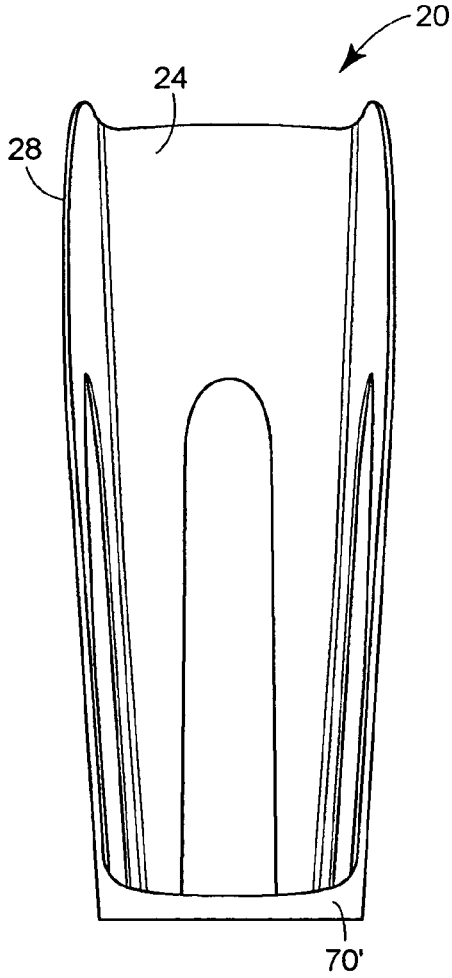
FIG. 7B shows a front elevational view of the article holder of FIG. 5 including an alternate front wall.

The front wall 70 can have a height sufficient to prevent an interference fit around the entirety of the adjacent contact areas between nested holders to make it easier for separating two of the nested holders. In this example, two nested holders will horizontally and vertically nest to an interference condition near the back wall 24 but will be limited in vertical nesting by the height of the front wall 70 to make it easier to separate the holders. If desired, a depending foot (not shown) can be provided on the perimeter or any portion of bottom surface 72 along or at least near the back wall. Such a foot can act as a vertical stop limiter for the rear end of each nested holder 20. A matching foot (also not shown) can then be added depending from the bottom surface 72 along or near the forward edge 36 so that each holder will sit flat on a surface during use. An alternate front wall 70' is shown in FIGS. 7A and 7B. The alternate front wall 70' includes a scalloped top edge as opposed to the flat top edge of FIG. 5.

As shown in the top view of FIG. 6, horizontal nesting is permitted to a depth until the exterior surfaces of one holder 20 come into interference contact with the interior surfaces of another holder 20. However, because the side walls 28 of one holder may be able to flex relative to one another, especially near the top opening 38 and the front opening 44, the holders will be relatively easy to separate, even when nested to a depth of considerable interference between the two holders. The side walls 28 are much less flexible relative to each other, if at all, nearer the attachments to the back wall 24 and bottom wall 22. Thus, the vertical nesting limiter provided by the front wall 70 prevents a nested configuration of two or more holders where the holders would be are extremely difficult to separate. As an alternative, small discardable spacers can be placed between nested holders 20 to act as nesting stop limiters where needed or believed beneficial. Alternatively, one of more rearwardly extending integral spacers can be formed extending from the exterior of the back wall 24, or one or more integral spacers can be formed extending forwardly from the interior of the back wall 24. Such spacers can limit horizontal nesting depth.

Figure 8:
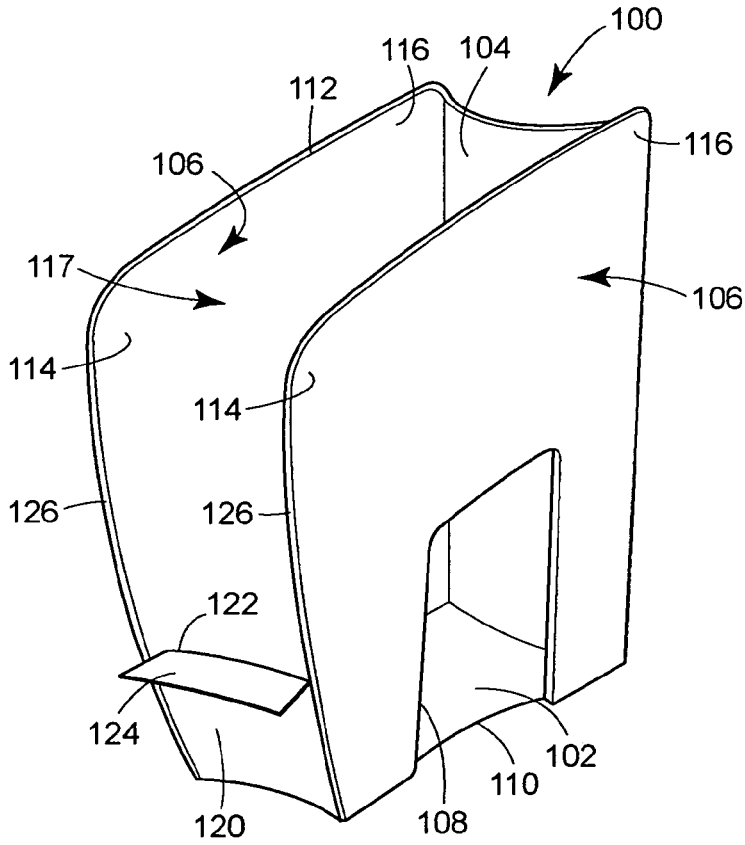
FIG. 8 shows another example of an article holder constructed in accordance with the teachings of the present invention.

FIG. 8 illustrates another example of a holder 100 constructed in accordance with the teachings of the present invention. The holder 100 is similar to the holder 20 described above in that is has a bottom wall 102, a back wall 104, and a pair of opposed side walls 106 similarly arranged relative to one another. In this example, the side walls 106 are depicted having side windows 108 that extend all the way to the side edges of the bottom panel and at least slightly into the bottom panel 102. This creates an inwardly curved side edge portion 110 in the bottom panel.

In this example, top ends 112 of the side walls 106 are slightly curved but not symmetrically curved as in the prior example. In this example, a front corner 114 of the side walls 106 is positioned substantially lower than a rear corner 116 such that the top ends 112 slope downwardly and forwardly. In this example, articles such as magazines or file folders stored within a storage receptacle 117 will be much more exposed and accessible at their respective front corners than at the back corners of the articles.

The holder 100 also includes a front wall 120 that is substantially higher than the front wall 70 of the holder 20 described in the previous example. The front wall 120 in this example is about one-quarter to about one-third the total height of the respective side walls 106. The front wall in this example terminates at an upper end 122 with a forwardly extending lip or ledge 124. In this example, the substantially higher front wall 120 provides a forward barrier for articles stored within the storage receptacle 117. The wall 120 prevents articles from inadvertently sliding forward from the receptacle 117 unless first being lifted to clear the wall.

Figure 9:
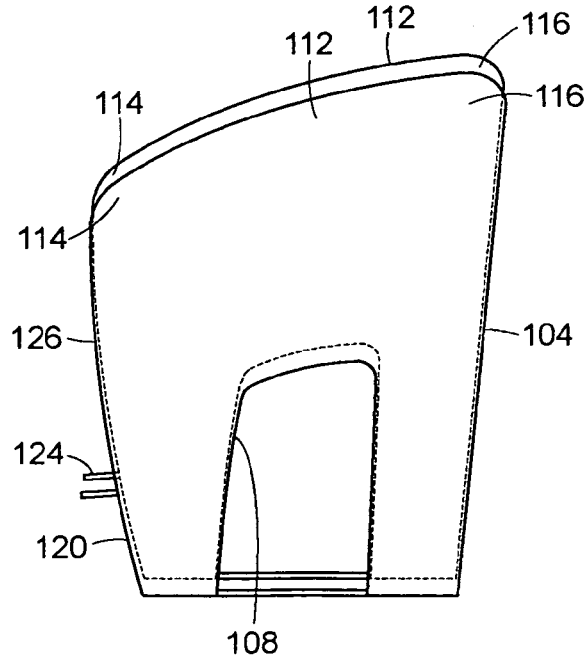
FIG. 9 shows a side view of two of the holders shown in FIG. 8 in a stacked and nested configuration.

As shown in FIGS. 8 and 9, the front ends 126 of the side walls 106 curve downwardly and inwardly so that the depth of the side walls is shorter near the bottom panel 102 than at their top ends 112. Thus, in this example, the front panel 120 is also angled forwardly moving up from the bottom panel 102, because it follows the contour of the side wall front ends 126.

As depicted in FIG. 9, the configuration of the front wall 120 permits a bottom end of one holder 100 to be received vertically downward within the storage receptacle of a second holder 100. The forwardly extending lip or ledge 124 of the interior holder 100 bears against the lip or ledge of the lower holder providing a nesting stop or limiter in a vertical direction. Again, the limiting feature of the ledge 124 prevents a tight interference or friction fit between two holders when nested together. Also in this example, the holders 100 are adapted to nest and stack vertically instead of horizontally as was the case in the previously described example.

Figure 10:
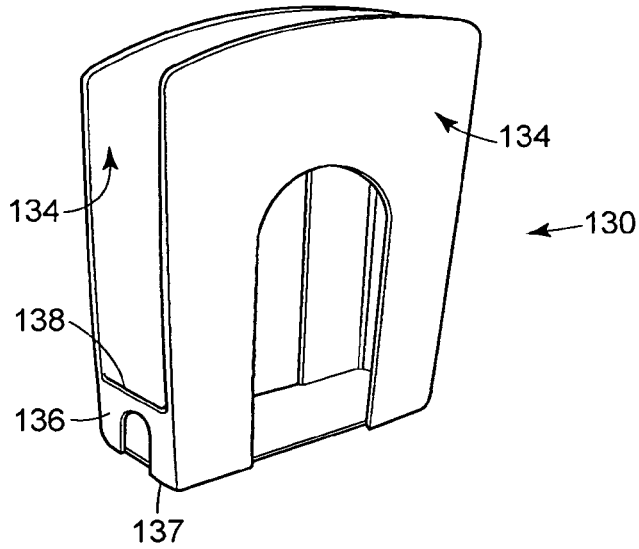
FIG. 10 shows a perspective view of another example of an article holder constructed in accordance with the teachings of the present invention.
Figure 11:
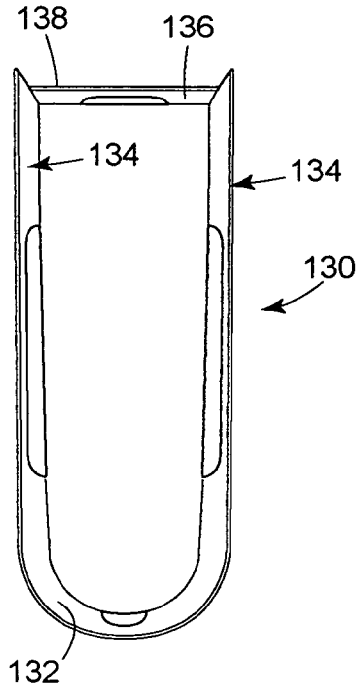
FIG. 11 shows a top view of the article holder of FIG. 10.
Figure 12:
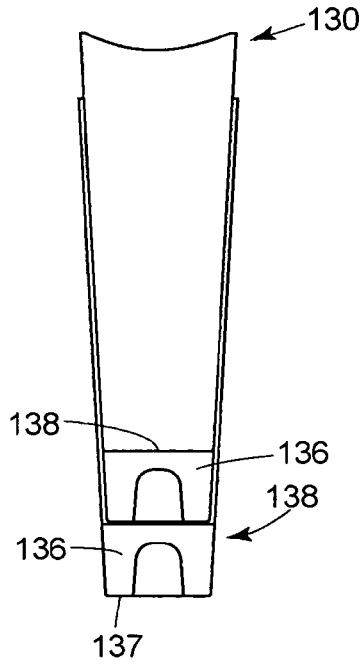
FIG. 12 shows an end view of two of the article holders of FIG. 10 in a stacked and nested configuration.

FIGS. 10-12 illustrate yet another example of an article holder 130 constructed in accordance with the teachings of the present invention. In this example, the holder 130 is constructed similar to the prior two examples, other than the variations described herein. In this example, the back wall 132 is outwardly curved and is a smooth continuation of the side walls 134. Also in this example, the holder 130 includes a front wall 136 that is significantly taller than the front wall 70 in the first example of FIG. 1. As depicted in FIG. 12, when the holders 130 are stacked vertically relative to one another, the bottom front edge 137 of one holder will bear against the top edge 138 of the front wall 136 of the next lower holder. In this configuration, the front wall itself provides the nesting stop or nesting limiter in a vertical direction. The front wall 136 in this example is only slightly angled forwardly to permit draft for molding and for vertical stacking and yet to prevent one holder from nesting within another holder to a level below the top edge 138 of the front wall of the one holder.

Figure 13:
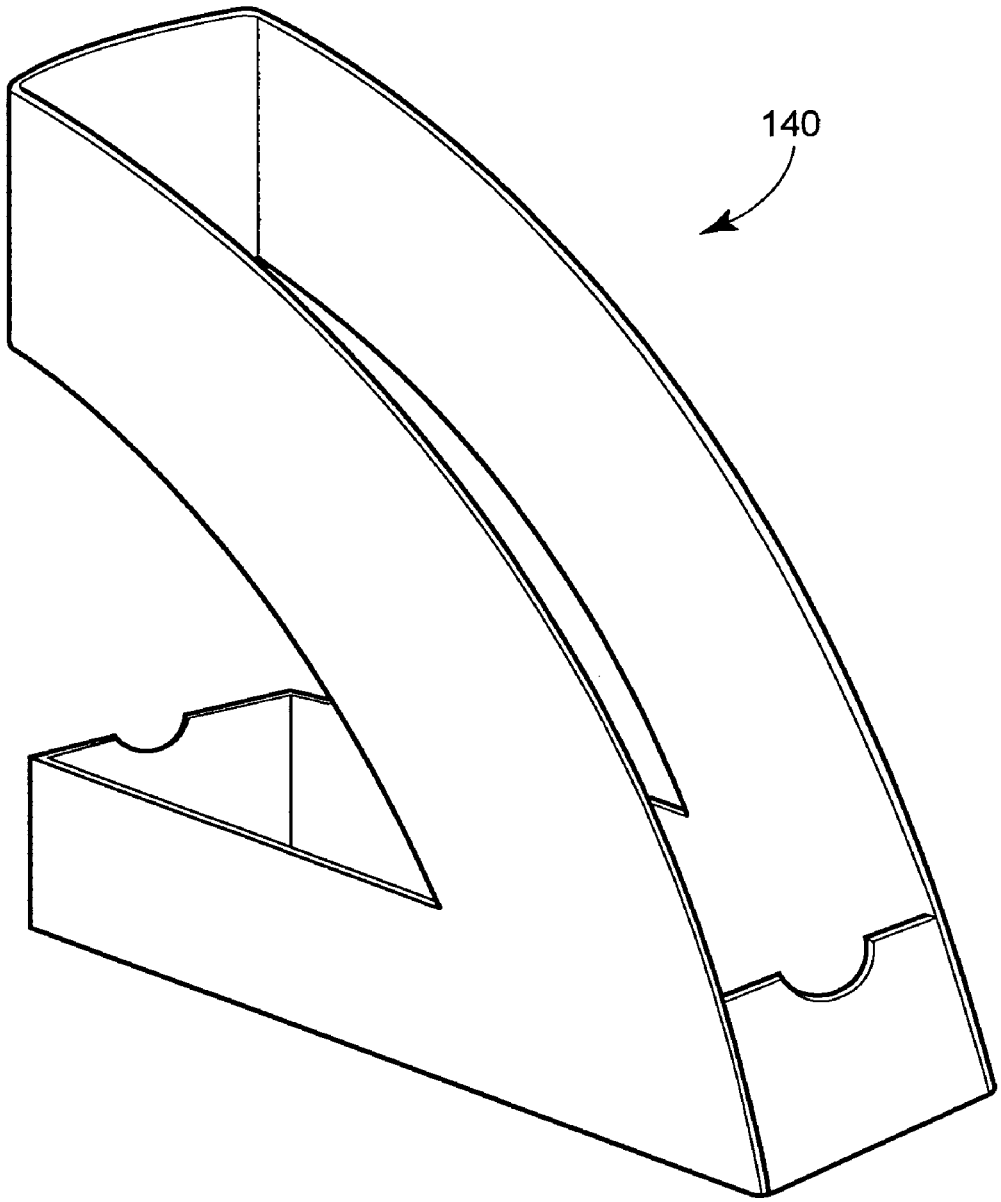
FIGS. 13-15 show additional examples of article holders constructed in accordance with the teachings of the present invention.
Figure 14:
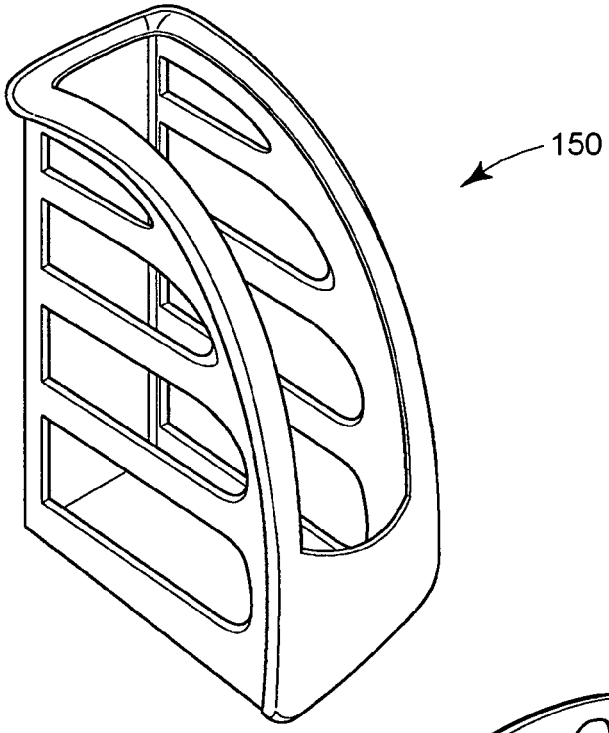
Figure 15:
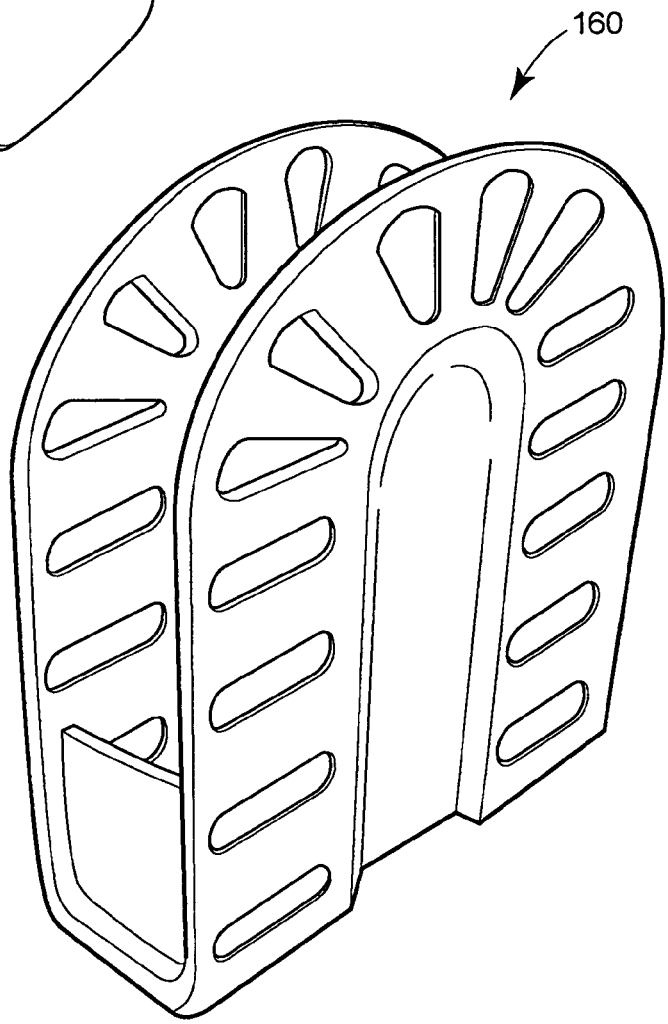
Figure 17:
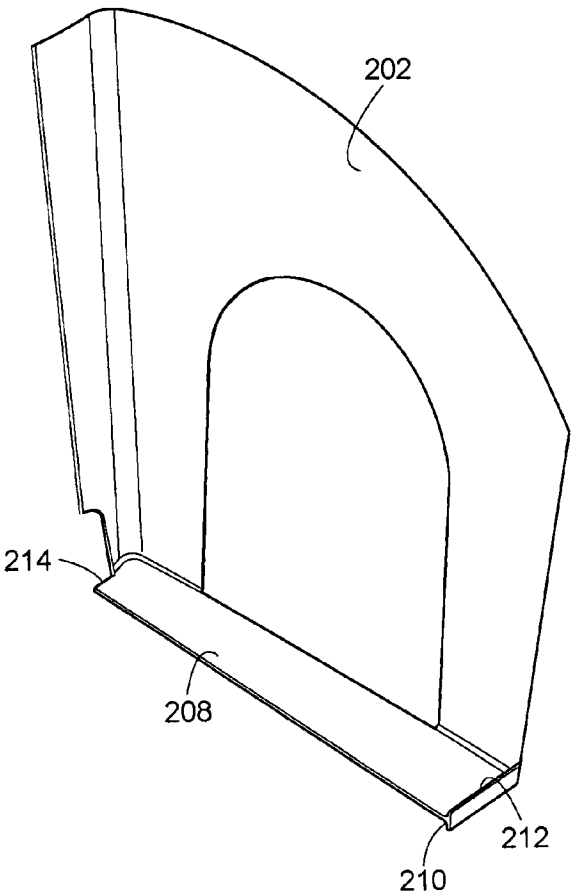
FIG. 17 shows a partial cut away perspective view of the article holder shown in FIG. 16.
Figure 16:
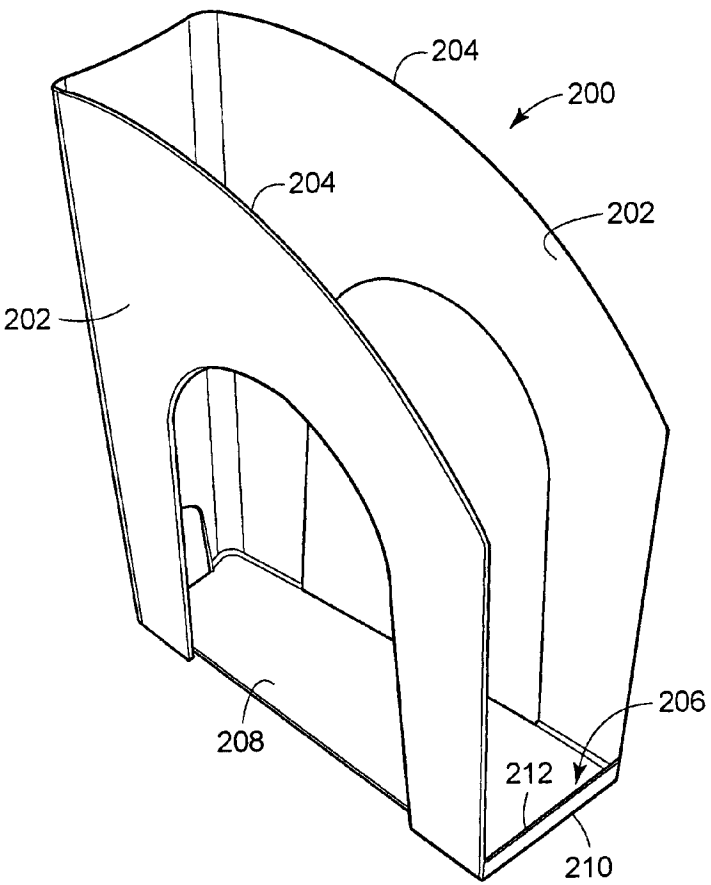
FIG. 16 shows a perspective view of another example of an article holder constructed in accordance with the teachings of the present invention.

FIGS. 13-15 illustrate yet additional examples of article holders 140, 150, and 160 respectively. These holders can be configured to provide the nesting and stacking capability described herein and yet that have different structural characteristics for the side walls, end walls, front walls, and the like. The holder 140 has optionally different side wall and back wall configurations. In this example, there are essentially two back walls, one between the bottom edges of the side walls and one between the upper edges of the side walls. Additionally, the holder 140 includes a continuous window that runs from one side wall, between the two back walls and into the other side wall. The holders 150 and 160 each have optionally different side wall windows. The holder 150 includes a generally straight back wall and two side walls which curve downward from back to front along the respective top edges and include a plurality of windows disposed therein. The holder 160 includes two generally arch shaped side walls with a plurality of windows disposed therein. As will be evident to those having ordinary skill in the art, the configuration and construction of the various walls and panels of the article holders described herein can vary considerably and yet fall within the spirit and scope of the present invention.

FIGS. 16-22 illustrate yet another example of a nestable and stackable article holder 200. The article holder in this example is somewhat similar to the example shown in FIGS. 1-7. However, the article holder 200 has side walls 202 with sloped and curved top edges 204 and has a different front end configuration. In this example as shown in FIGS. 16, 17, 19, and 22, the front edge 206 of the bottom panel 208 has a depending front foot 210 that extends downward from the front edge 206 and has an upstanding short front wall 212. The short front wall 212 provides the vertical spatial separation between two horizontally stacked ones of the holder 200, similar to the previously described example of the holder 20. The front foot 210 is provided to keep the bottom panel level to a ground surface in view of the addition of a rear depending foot described below.

Figure 21:
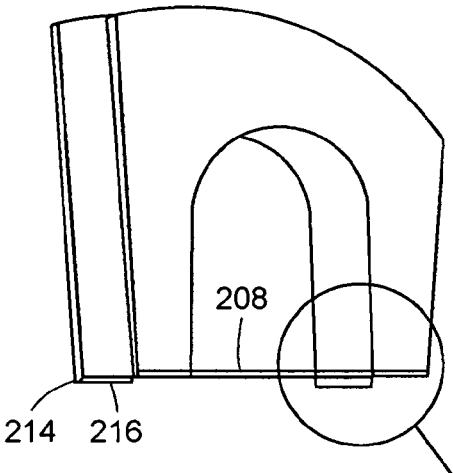
FIG. 21 shows a side cross-sectional view of the article holder stack of FIG. 20.
Figure 22:
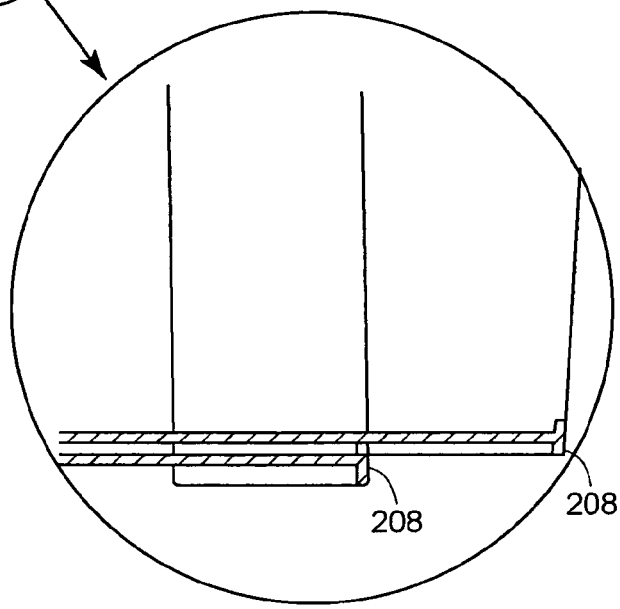
FIG. 22 shows an enlarged cross-sectional side view of a front portion of the article holder stack of FIG. 21.

As can be seen in FIG. 21, the rear edge 214 of the bottom panel 208 also has a depending rear foot 216 that extends downward from the bottom panel. The rear foot 216 is of a height that is similar to or the same as the front foot 210 such that the holder 200 will rest on a surface with bottom panel 208 parallel to the surface. The rear foot 216, as can be seen in FIG. 21, also provides spatial separation between the two stacked holders 200. When stacked, the feet 210 and 216 prevent the side walls 202 of the nested holders from becoming tightly packed and frictionally engaged with one another. Thus, when a consumer wishes to separate two stacked holders, the holders will not be locked together making it easy to lift and/or draw one holder from the other.

Figure 19:
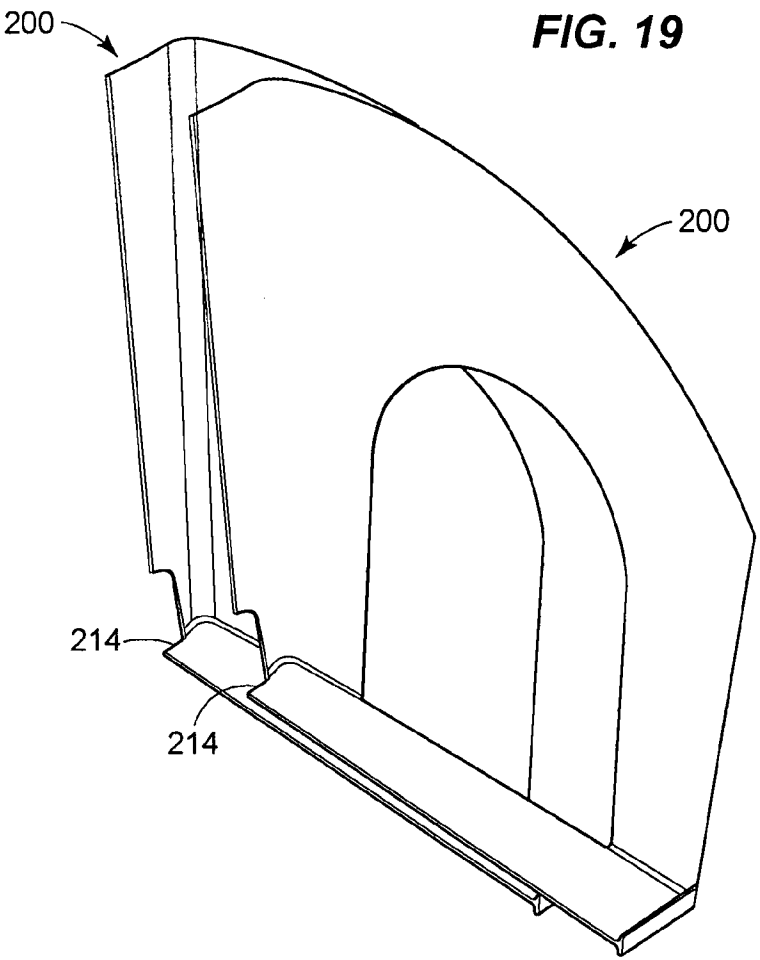
FIG. 19 shows a partial cut away perspective view of the article holder stack of FIG. 18.
Figure 18:
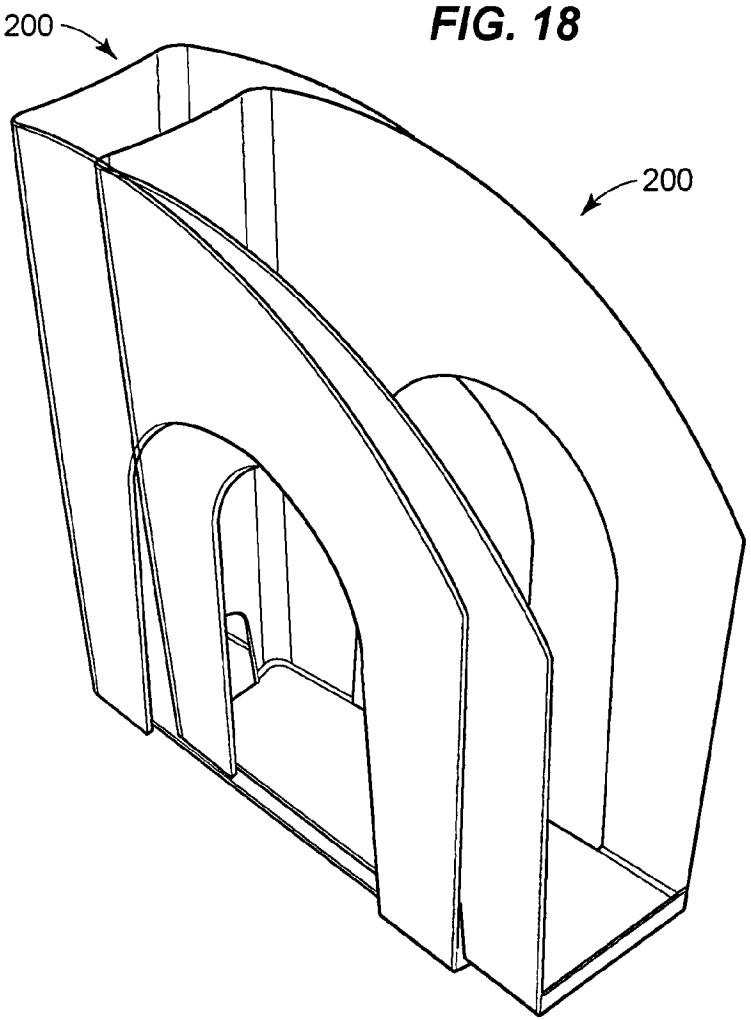
FIG. 18 shows two of the article holders of FIG. 16 and horizontally stacked and nested with one another.
Figure 20:
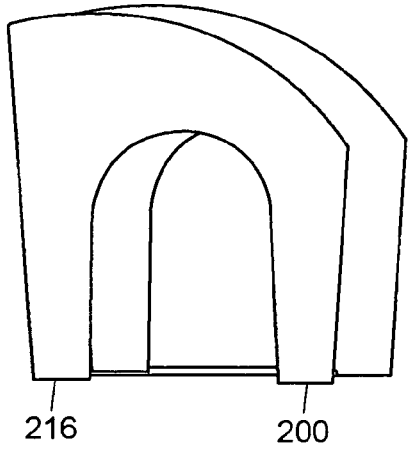
FIG. 20 shows a side view of the article holder stack of FIG. 18.

As represented in FIGS. 19-21, the front and rear feet can extend either alternatively or additionally from at least portions of the side edges of the bottom panel 208, if desired. Thus, the front feet 210 can be extensions of the side walls and/or the bottom panel and the rear feet 216 can be extensions of the side walls, rear wall, and/or the bottom panel and yet perform the intended functions. Further, the front and rear feet need not be positioned along all or part of the front and rear edges of the holder 200. The feet can instead be partly or entirely positioned along the sides of the holder.

Again, the holders 200 can be made from any material desired, but in one example are formed from a molded plastic material. Other materials such as metal, wood, or the like can also be utilized and yet fall within the spirit and scope of the present invention.

Figure 23:
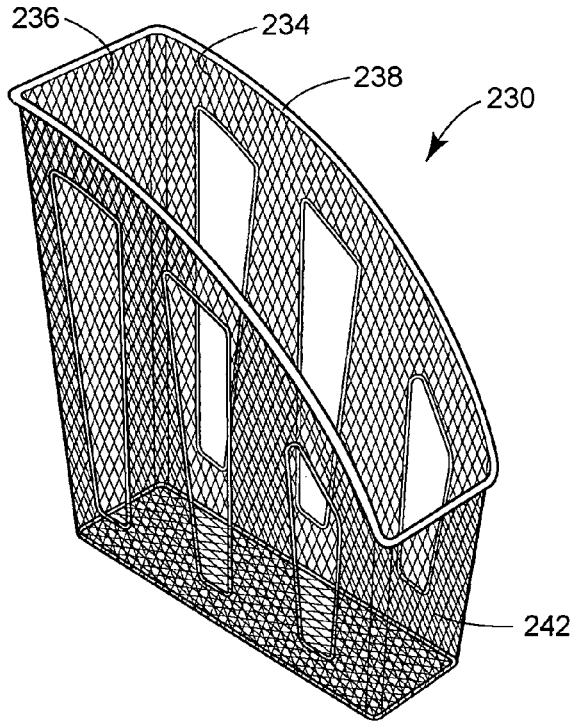
FIG. 23 shows a perspective view of another example of an article holder constructed in accordance with the teachings of the present invention.
Figure 24:
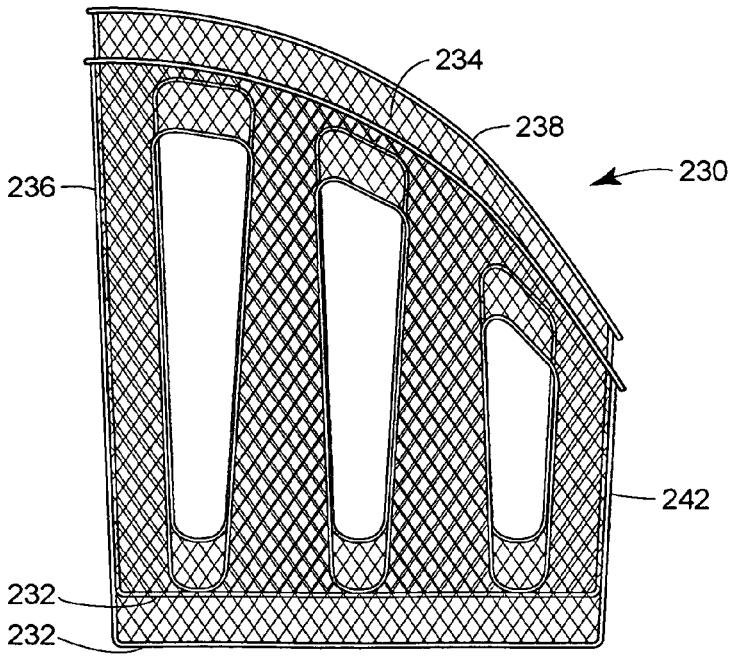
FIG. 24 shows a side view of two of the article holders of FIG. 23 and vertically stacked with one another.
Figure 25:
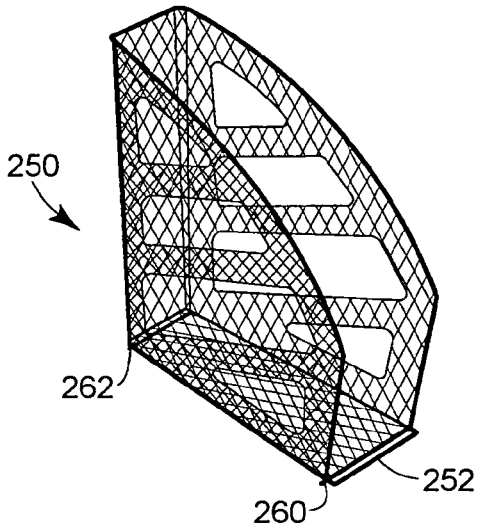
FIG. 25 shows a perspective view of another example of an article holder constructed in accordance with the teachings of the present invention.
Figure 26:
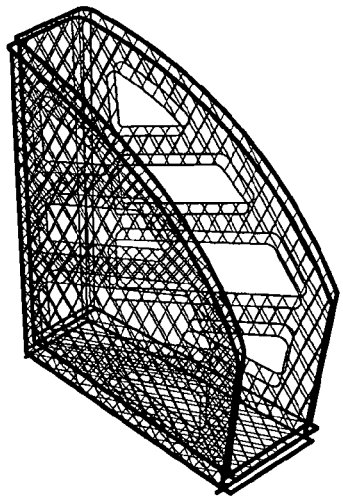
FIG. 26 shows a perspective view of two of the article holders of FIG. 25 and vertically stacked with one another.

FIGS. 23 and 24 illustrate yet another example of an article holder 230 which is formed from wire and/or mesh material. The bottom panel 232, side walls 234, and rear wall 236 are all formed from wire mesh whether bent to form or cut and secured together, such as by welding. The holder 230 can include wire support structures along portions of the holder, such as along the corners and top edges 238, for example, of the side walls, if desired. Further, the surfaces of the wire mesh walls and panels can be formed to include three dimensional depressions, bulges, and/or other surface contours as rigidity enhancing and/or aesthetic features to the holder. The mesh can be plastic molded, metal, or the like.

In the example shown in FIGS. 23 and 24, the holder 230 also includes a partial front wall 242 that is about half the height of the rear wall 236 in this example. The significant height of the front wall prevents horizontal stacking the holders 230 in this example. However, the generally vertically extending walls 234, 236, and 242 can be slightly tapered as shown in FIG. 24 to permit vertical stacking of the holders. Because the holders 230 are formed from a mesh wall material, the holders are less likely to become frictionally locked. This is because the perforate walls will inherently have less surface area than solid walls, and because the perforations in the mesh will allow air to pass through the walls to at least reduce the likelihood of frictional engagement between two or more stacked holders 230.

Figure 28:
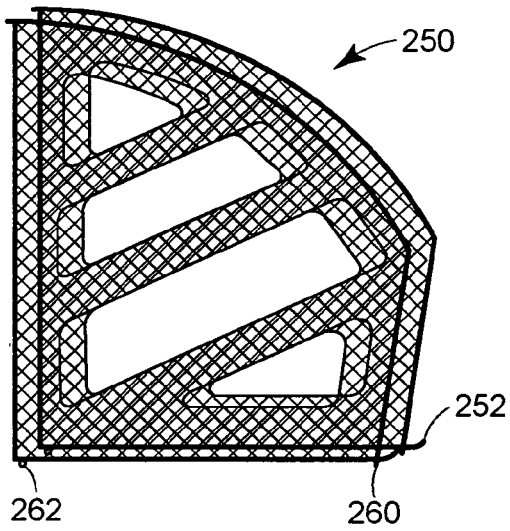
FIG. 28 shows a side view of the article holder stack of FIG. 26.
Figure 27:
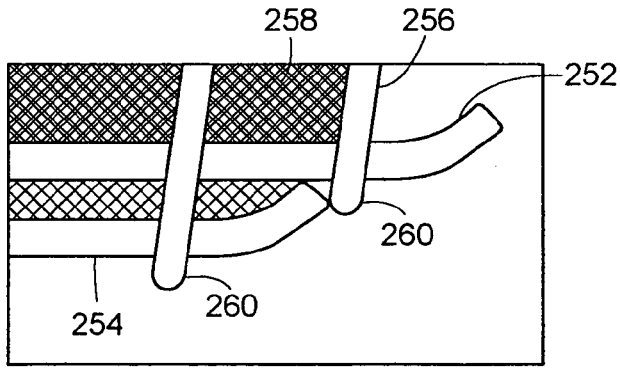
FIG. 27 shows an enlarged side view of a front portion of the article holder stack of FIG. 26.

FIGS. 25-28 illustrate another example of an article holder 250 that is also constructed of a wire and/or mesh material. In this example, no front wall is present. Instead, the holder 250 has an open front with an upturned front edge 252. The front edge of the bottom panel 254 is bent upward and thus elevated above the surface of the remainder of the bottom panel. A vertical support wire 256 extends along a front edge of each side wall 258 and is turned under the holder 250. The portion of the wire beneath the bottom panel 254 defines a front foot 260. Similarly, a rear wire is welded, bent or otherwise formed to extend beneath the bottom panel 254 near the rear edge to form a rear foot 262. When in use, the holder rests on the feet 260, 262. When stacked as shown in FIGS. 27 and 28, the upturned front edge 252 of the lower holder bears against the bottom of the upper holder and seats against the wire of the front foot 260. The rear foot 262 of the upper holder 250 bears against the top surface of the bottom panel. The feet 260 and 262 can be provided to prevent tight nesting of the stacked holders 250 and, thus, permit easy removal of the upper holder of the stack.

As will be evident to those having ordinary skill in the art, the wire and/or mesh configuration and arrangement can vary considerably and yet fall within the spirit and scope of the present invention. The two different wire mesh examples in FIGS. 23-28 illustrate examples of such permissible variation. Also, features of the various embodiments disclosed herein can be mixed and combined with other features of the other embodiments.

Merchandisers and retailers of vertical orientation magazine and file holders typically provide shelf space and arrangements that vary from store to store and from retailer to retailer. Thus, a product configuration that is suitable for display in a shelf space at one store or retailer may not be suitable for a shelf space or display configuration at another. The disclosed article holders permit stacking and nesting of a large number of the products. The disclosed products or holders can thus be displayed, packaged, shipped, stocked, stored, and the like within a relatively small amount of shelf space.

By maximizing use of packaging and shipping space as well as store shelf space by utilizing the disclosed article holder configurations, one is able to ship and store a larger product volume per unit of available space. This creates more space within an existing product display in a limited shelf storage space that was originally suited for a completely different product. This can increase revenue dollars for the retailer per square foot of shelf space. This can also permit adding the disclosed article holders to an existing shelf space without having to knock out another product from the shelf space.

Article holders for storing items such as magazines or file folders in a vertical orientation have not heretofore been designed for nestability in the manner disclosed herein. Some solutions have been devised, but these typically require that the article holders offered for sale be provided in several pieces and partially dismantled. Also, such products typically are packaged to protect the articles from being damaged by one another, such as by being scuffed, scratched, or the like while being shipped or while on display for sale.

In contrast, the disclosed article holder configurations may eliminate or significantly reduce the need for utilizing foam, paper, corrugated elements, poly bags, or other such packing materials. Instead, the disclosed article holders can be shipped, stored, and displayed in tightly nested stacks. The stacks will provide stability to the shipped, stored, and displayed products. The products can stand alone with limited or no packing materials in shipping containers or on a shelf storage space for sale, and yet be tightly packed to inhibit relative movement and thus damage.

Some other existing office products of the type described herein are capable of nesting, but only with one other like product. Further, the two products must be inverted or turned upside down and rotated 180 degrees relative to one another in order to nest with one another. These types of products, however, must still utilize additional packing to prevent the products from moving relative to one another, which would otherwise cause scuffing or scratching. Such known products do not typically optimize the use of shelf, shipping, and storage space to the degree that the disclosed article holders can accomplish. In one example, a known magazine holder can be inverted, rotated, and rested on top of an identical holder so that two of the products can be overlapped with one another. However, such an arrangement is limited to only two products being nested with one another.

The disclosed article holders achieve the objective of substantially reducing the necessary space required for shipping, storage, and retail sale, all the while maintaining standard function for such products. Standard function is typically to be suitable for storing magazines, file folders, or similar sized documents. A number of the disclosed article holders can nest bi-directionally, i.e., horizontally and/or vertically, while still meeting the aforementioned function and yet minimizing the possibility of product damaged during shipping.

The materials and processes used to manufacture the disclosed article holders can vary considerably and yet fall within the spirit and scope of the present invention. However, in one example, the article holders disclosed herein can be manufactured using an injection molding process. The materials utilized in one example can be commodity plastics such as polystyrene or polypropylene. However, many other materials may be suitable for forming the disclosed article holders. For example, other materials may include engineering grade plastic materials such as polycarbonate, ABS or TPE. Other commodity thermoplastics, or even further alternative materials such as metal, wood, organic materials, leather, glass, paperboard, or variations and combinations of these materials including fabrics and woven materials. Material selection may assist in creating a higher impact strength, flexibility, improved resistance to scratching or scuffing, or enhanced appearance. The material selection can be undertaken with the most important characteristics in mind for a given application. However, engineering plastics such as polystyrene or polypropylene also can reduce consumer cost.

The disclosed article holders can be painted, decorated, or in-molded with labels, graphics, or other layers or accents. These additional design characteristics can be employed to protect the surfaces of the article holder or to enhance the decorative nature of the product. Combinations of materials can be utilized and assembled in any suitable way, including forming a plastic underbody product having a rubber overmolded on the plastic base material. Alternatively, metal parts can be mechanically fastened together or wood products can be covered with suitable decorative materials such as fabric, metal decorative and protective corner features, and the like.

Depending upon the materials selected, the manufacturing processes and methods used can also vary and be employed as needed. In one example, a plastic article holder disclosed herein can be molded using a simple two part mold. The draft angle of the side walls, front wall, and back wall can provide the necessary mold draft for easy formation and removal of parts from the mold cavities. The windows in the walls can be formed by providing shut-offs or surface-to-surface metal contact within the mold. By extending the windows into both the side and back walls and at least slightly into the bottom panel, the shut-off can be provided and yet permit easy mold separation and part removal.

The disclosed article holder configurations improve upon maximizing retail shelf space, accommodate variable shelf space configurations, and enhance product nesting for sale. Product nesting can be accomplished in a by-directional manner, with a number of the disclosed examples to permit stacking in both a horizontal and/or a vertical arrangement. The stacked products can be displayed and shipped without damage to the product due to scuffing, scrapping, and the like because the products will be tightly nested. Additional packing can be negated. The disclosed article holders also provide multiple article access points so that a user can easily grasp materials stored within the holder at more than one location. Examples disclosed herein that permit only horizontal or vertical stacking provide essentially the same benefits.

Additionally, freight cube size can be optimized and significantly reduce utilizing the disclosed article holder configurations. Products shipped in bulk can also be directly unloaded from the master carton or shipping box onto a shelf. No additional reorientation of the product may be necessary, making the merchandiser's handling of the product easier. The nested products also assist in retaining the displayed article holders on a retail shelf space. The products also look more organized when nested as disclosed herein. This reduces the amount of work required by the customer/merchandiser to keep the shelf display organized and arranged. An organized shelf space may effect the perception of the consumer and influence his or her decision to buy the displayed products.

Further, because more product can be displayed for sale in a given amount of shelf space, less restocking time and stocking space is necessary for the retailer. Having more product available for sale at any one time reduces the frequency of an item appearing to be out of stock. This can prevent a consumer from leaving the establishment to go elsewhere to find the desired product.

The disclosed article holders are well suited for holding items such as magazines or the like. However, holders with no front panel or only a short wall, as disclosed herein, are particularly well suited for storing binders such as three-ring binders or the like. Where no significant front wall is present, binders, which are often heavy when full of stored items, can be easily slid horizontally into and out of the storage space of the holder. Also, holders with no front wall present may be bi-directionally nestable. In other words, the holders can be nested either vertically or horizontally with one another. This feature, if provided, creates versatility for shipping, packaging, and display in retail stores which known holders do not. Stacks of bi-directionally stackable holders can be created either vertically or horizontally as desired to fit a particular available package or display space.

Although certain article holders for storing and organizing magazines, file folders, documents, and the like have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. An article holder comprising:

a bottom panel having a rear edge, a forward edge, and a pair of opposed side edges;

a back wall extending upward near the back edge of the bottom panel and having a lower edge, an upper edge, and a pair of side edges, the back wall diverging from a plane that is substantially perpendicular to the bottom panel moving up away from the bottom panel;

a pair of side walls spaced apart and opposed relative to one another, one each extending forward from a respective one of the side edges of the back wall and generally upward relative to a respective one of the side edges of the bottom panel, the pair of side walls diverging away from one another both moving up away from the bottom panel and moving forward from the back wall; and a storage receptacle defined above the bottom panel, forward of the back wall, and between the side walls, the storage receptacle having a width that is greater near top edges of the side walls than near the bottom panel.

2. The article holder of claim 1, wherein the storage receptacle height and depth are each greater than a width between the pair of side walls.

3. The article holder of claim 1, wherein the back wall is convexly curved inward and into the storage receptacle of the article holder between the side edges of the back wall.

4. The article holder of claim 1, wherein the back wall includes at least one opening therein.

5. The article holder of claim 4, wherein the opening extends downward to and at least partially into the rear edge of the bottom panel.

6. The article holder of claim 1, wherein the forward edge of the bottom panel is curved inwardly.

7. The article holder of claim 1, wherein the top edges of the side walls are arched so that the side wall is taller at a mid-portion than at the front end or the rear end.

8. The article holder of claim 1, wherein the side walls each include an opening therein.

9. The article holder of claim 8, wherein the openings extend downward into side edges of the bottom panel.

10. The article holder of claim 1, wherein the side walls diverge from each other at an angle that is in a range of approximately 1 degree to approximately 7 degrees.

11. The article holder of claim 1, further including a front wall extending upward from the forward edge of the bottom panel.

12. The article holder of claim 11, wherein the front wall acts as a vertical nesting stop when like article holders are nested.

13. The article holder of claim 1, wherein the side walls flexibly deform relative to one another when lateral forces are applied near a top opening of the article holder.

14. The article holder of claim 1, wherein the forward edge of the bottom panel terminates in an upturned forward edge.

15. The article holder of claim 1, wherein the bottom panel, side walls, and back wall are manufactured from a material selected from a group consisting of engineering grade plastic, polycarbonate, ABS, TPE, thermoplastic, metal, wood, organic materials, leather, glass, or a combination thereof.

* * * * *